US007401743B2

(12) United States Patent
Brown et al.

(10) Patent No.: US 7,401,743 B2
(45) Date of Patent: Jul. 22, 2008

(54) HOLDING BRACKET FOR HOT-WATER BASEBOARD

(75) Inventors: Donald Brown, Sea Cliff, NY (US); George Weintraub, Brooklyn, NY (US)

(73) Assignee: Slant/Fin Corporation, Greenvale, NY (US)

( * ) Notice: Subject to any disclaimer, the term of this patent is extended or adjusted under 35 U.S.C. 154(b) by 419 days.

(21) Appl. No.: 11/117,600

(22) Filed: Apr. 25, 2005

(65) Prior Publication Data

US 2006/0237553 A1 Oct. 26, 2006

(51) Int. Cl.
*F24H 3/00* (2006.01)

(52) U.S. Cl. ..... 237/70; 165/96

(58) Field of Classification Search ..... 237/70, 237/71; 165/55, 96, 181, 182
See application file for complete search history.

(56) References Cited

U.S. PATENT DOCUMENTS

| | | | | |
|---|---|---|---|---|
| 4,010,348 | A * | 3/1977 | Salinger | 392/423 |
| 4,086,468 | A * | 4/1978 | Keldmann | 392/352 |
| 4,750,546 | A * | 6/1988 | Godbout et al. | 165/55 |
| 5,884,690 | A * | 3/1999 | Zussman et al. | 165/55 |
| 6,834,710 | B2 * | 12/2004 | Weintraub et al. | 165/55 |

* cited by examiner

*Primary Examiner*—Derek S Boles
(74) *Attorney, Agent, or Firm*—Andrew Wilford

(57) ABSTRACT

A hydronic baseboard heater for use with PEX tubing has a hold-down bracket which is snapped into the baseboard enclosure to engage the tube of the finned tube element and provide additional support when flexible PEX tubing is used.

6 Claims, 2 Drawing Sheets

HOLDING BRACKET FOR HOT-WATER BASEBOARD

FIELD OF THE INVENTION

The present invention relates to a holding bracket for a baseboard heater and a hot-water baseboard provided with such hold-down bracket. More particularly the invention relates to a hot-water baseboard connected to PEX (cross-linked polyethylene) tubing and a bracket for the finned tubing at the end connected to the PEX tubing.

BACKGROUND OF THE INVENTION

While hydronic baseboards holders through which hot water is circulated have been connected to rigid piping systems over many years, more recently the development of PEX tubing for hydronic applications has led to the connection of baseboards in the hydronic system by such tubing through fittings between an end of the finned-tube element and the PEX tubing. Such fittings may be threaded brass fittings soldered to the copper tube of the finned-tube element and joined to the PEX tubing by a compression nut.

It has been found in practice that additional bracing may be required for the end of the finned-tube element which is connected to the PEX tubing and which in earlier hydronic systems was held rigidly by attachment to fixed piping systems.

In other words the use of flexible piping like PEX tubing has mandated additional bracing at the point at which the PEX tubing is connected to the finned-tube element of a baseboard heater.

OBJECTS OF THE INVENTION

It is, therefore, the principal object of the present invention to provide an improved baseboard heater with additional support for connection of the finned tube element thereof to PeX tubing.

Another object of this invention is to provide a hold-down bracket for the additional bracing of finned-tube elements of hydronic baseboards to eliminate problems encountered when such additional bracing is omitted.

Still another object of the invention is to provide an improved baseboard system with significant advantages over earlier arrangements.

SUMMARY OF THE INVENTION

These objects and others which will be apparent hereinafter are attained, in accordance with this invention, with a hold-down bracket which can be snapped into upper and lower channels of an enclosure of a baseboard heater and from which a plate extends to engage and brace the metal tube of the finned-tube element between the fin array and the connection of that metal tube to the PEX tubing.

More particularly a baseboard according to the invention can comprise:

- an elongated enclosure configured for convective flow of air upwardly therethrough;
- an elongated heating element extending within and mounted in the enclosure and comprised of a metal tube having a connection end, and an array of metal fins spaced from the connection end;
- cross-linked polyethylene tubing having a fitting joined to the connection end for passing hot water through the metal tube; and

- a hold down bracket engaged in the enclosure and fitting at least partly around the tube between the connection end and the array.

The hold-down bracket can comprise:

a substantially planar sheet-metal body formed with upper and lower bent portions engaging in channels formed in the enclosure at a top and bottom thereof, and a generally L-shaped transverse plate connected to the body by a fold and fitting over the tube between the connection end and the array.

The hold-down bracket can be formed with flanges bent perpendicular to a plane of the plate along edges thereof adjacent the tube.

At least one further flange can be provided on the plate along an edge thereof opposite an edge adjacent the tube. The plate, body and bent edges at the top and bottom can all be formed in one piece from an electrogalvanized iron strip, i.e. stamped sheet metal.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
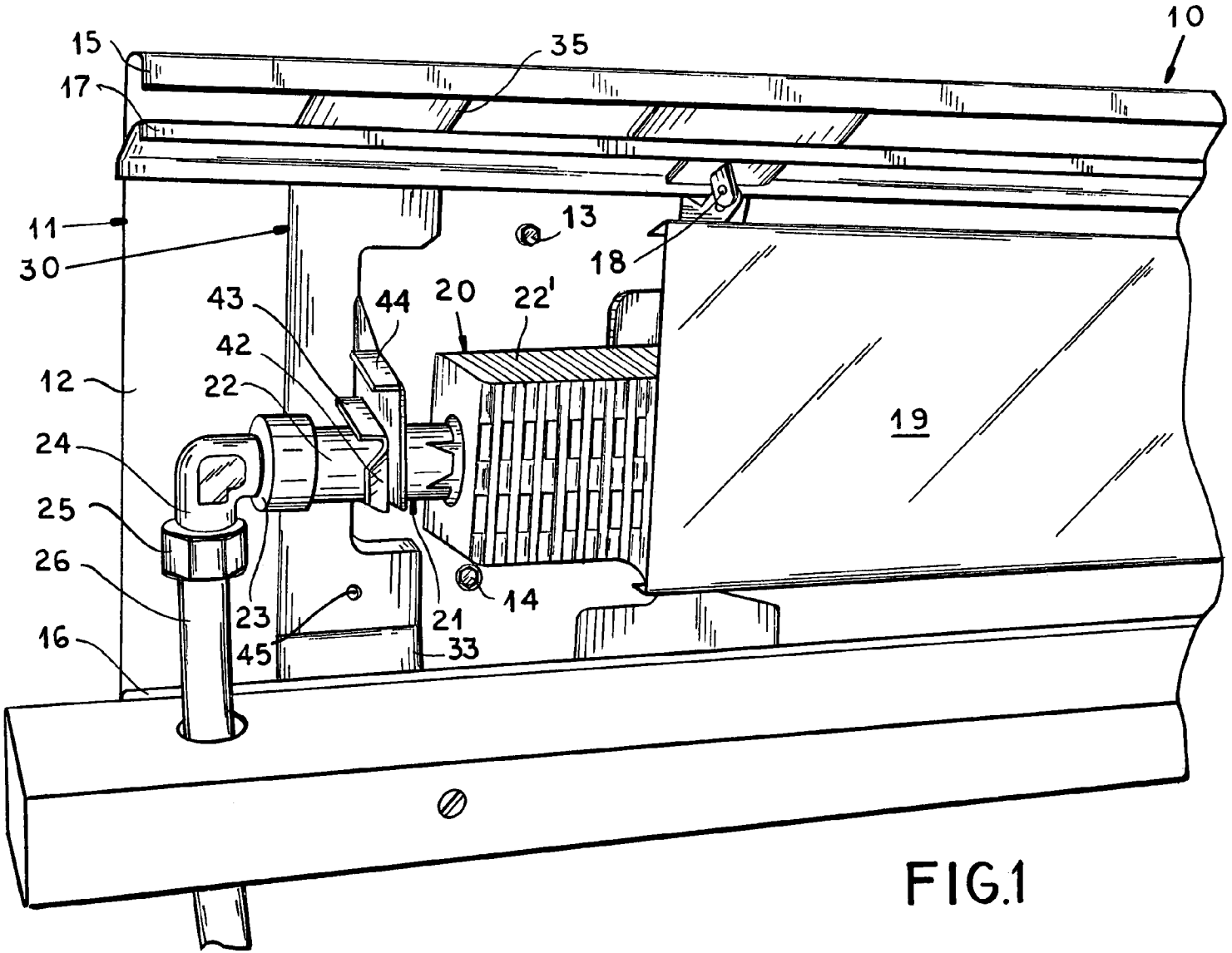
FIG. 1 is a perspective view showing a portion of a baseboard heater according to the invention.

The hydronic baseboard, according to the invention comprises an enclosure 10 formed by a sheet metal housing 11 having a back wall 12 normally lying on a wall of a structure to which the baseboard is attached, e.g. by screws 13 and 14, and having bent-over channels 15 and 16 at the top and bottom. A baffle 17 is pivotally mounted in the enclosure at 18 and serves to direct the flow of conductive air between the housing 12 and the front plate 19 which normally covers the heating element represented at 20 and constituted as a finned tube unit.

The finned-tube unit comprises a metal tube 21, e.g. of copper, and an array of fins 22, e.g. of aluminum, secured to the tube 21. The tube 21 has a connected end 22 to which an elbow fitting 23 can be soldered and that fitting can have a male threaded portion 24 onto which a compression nut 25 of the PEX tubing 26 is threaded. The tubing shown in FIG. 1 can be the supply tubing or the return tubing for the hot water which is to traverse the element 20.

According to the invention, a hold-down bracket 30 can be provided to engage the end 22 of the tube 21 which is connected to the PEX tubing 26.

Figure 3:
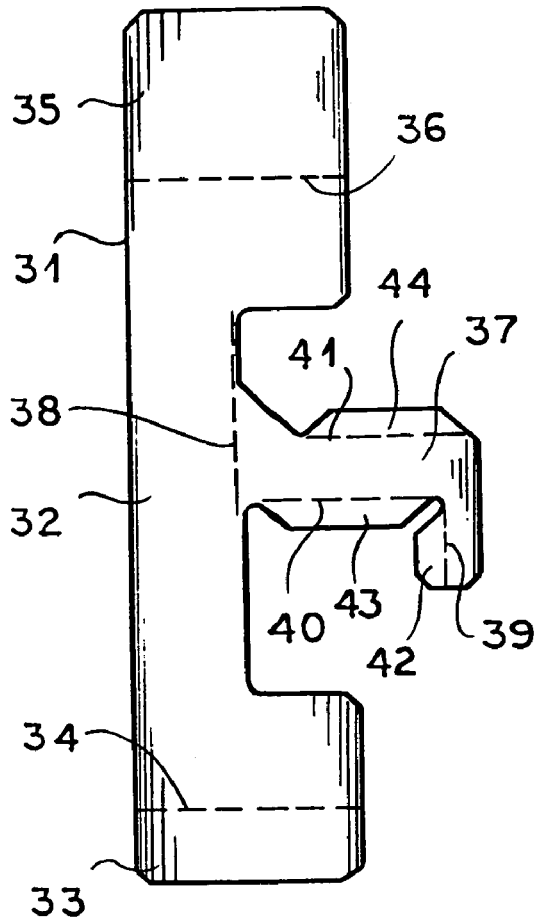
FIG. 3 is an elevational view of the stamped-out sheet metal blank from which the hold-down bracket is bent.

To this end a blank 31 (FIG. 3) is stamped from electrogalvanized or sheet metal and has a body 32 connected to a lower flange 33 by a fold line 34 and an upper flange 35 by a fold line 36.

Figure 2:
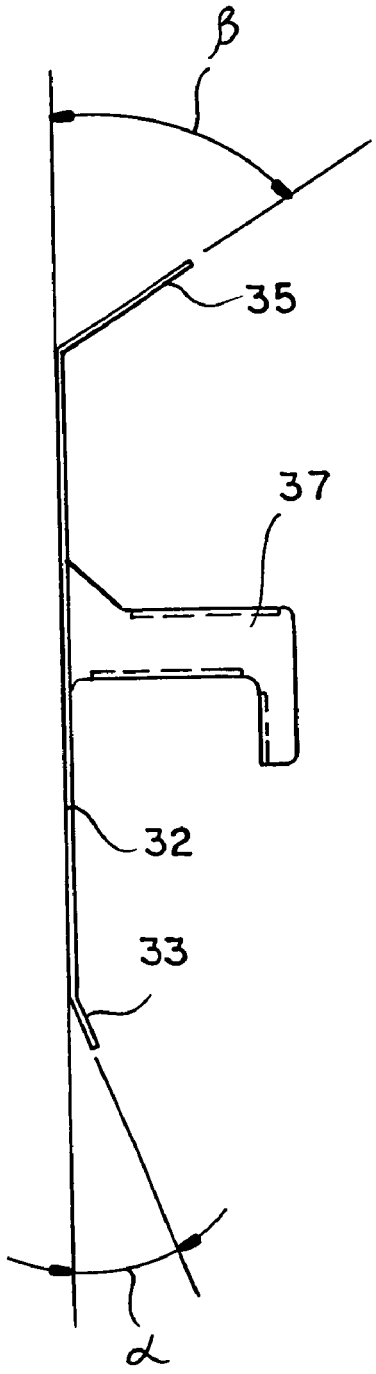
FIG. 2 is a side view of the hold-down bracket of the present invention.

An L-shaped plate 37 is connected by a fold line 38 to the body 32 and has fold lines 39, 40 and 41 on which flanges 42, 43 and 44 can be folded at right angles to the plate 37. As can be seen from FIG. 2, the flange 33 may be bent at an angle a of say 21° forwardly from the body 32 while the flange 35 may be bent forwardly at an angle β of say 58° so that the flange 35 can first be snapped into the channel 15 and the flange 33 then snapped into the channel 16 where the bracket is to be mounted in the enclosure 11. The L-shaped plate 37 bent at a right-angle to the body 32 reaches over and braces the tubing 21 between the connection end 22 and the array of fins 20.

The flanges 43 and 42 lie along the tube 21 while the flange 44 additionally reinforces the plate 37. A hole 45 in the bracket can be traversed by a screw passing through the bracket and the back wall 12 into the wall to which the baseboard 30 is affixed, to additionally hold the bracket in place.

We claim:

1. A hot-water baseboard heater comprising:

an elongated enclosure configured for convective flow of air upwardly therethrough;

an elongated heating element extending within and mounted in said enclosure and comprised of a metal tube having a connection end, and an array of metal fins spaced from said connection end;

cross-linked polyethylene tubing having a fitting joined to said connection end for passing hot water through said metal tube; and a hold down bracket engaged in said enclosure and fitting at least partly around said tube between said connection end and said array, the hold down bracket comprising a substantially planar sheet-metal body formed with upper and lower bent portions engaging in channels formed in the enclosure at a top and bottom thereof, a generally L-shaped transverse plate connected to the body by a fold and fitting over the tube between the connection end and the array, first and second flanges bent perpendicular to a plane of the plate along edges thereof adjacent the tube;

a third flange bent perpendicular to the plate and perpendicular to the body.

2. The baseboard defined in claim 1 wherein said body is formed with a hole adapted to be traversed by a screw passing through said body and a back of said enclosure into a wall behind the baseboard heater.

3. The baseboard defined in claim 2 formed in one piece from sheet metal.

4. A hold down bracket for engagement with a finned tube heating element of a hydronic baseboard in which a connection end of the tube is connectable to cross-linked polyethylene tubing, said hold down bracket comprising a substantially planar sheet-metal body formed with upper and lower bent portions engageable in channels formed in an enclosure of the baseboard heater at a top and bottom thereof, a generally L-shaped transverse plate connected to said body by a fold and fitting over said tube between said connection end and the array of fins of the heating element;

first and second flanges bent perpendicular to a plane of the plate along edges thereof adjacent the tube, and a third flange bent perpendicular to the plate and perpendicular to the body.

5. The hold down bracket defined in claim 4 wherein said body is formed with a hole adapted to be traversed by a screw passing through said body and a back of said enclosure into a wall behind the baseboard heater.

6. The hold down bracket defined in claim 5 formed in one piece from sheet metal.

* * * * *